US008970326B2

(12) United States Patent
Horiuchi et al.

(10) Patent No.: US 8,970,326 B2
(45) Date of Patent: Mar. 3, 2015

(54) COAXIAL RESONATOR AND DIELECTRIC FILTER FORMED FROM A DIELECTRIC BLOCK WITH AT LEAST ONE INNER CONDUCTOR SURROUNDED BY A NON-CONDUCTIVE RECESS

(75) Inventors: Masafumi Horiuchi, Kirishima (JP); Hiromichi Yoshikawa, Kirishima (JP); Katsuro Nakamata, Kirishima (JP); Soutarou Kukita, Kirishima (JP)

(73) Assignee: Kyocera Corporation, Kyoto (JP)

( * ) Notice: Subject to any disclaimer, the term of this patent is extended or adjusted under 35 U.S.C. 154(b) by 273 days.

(21) Appl. No.: 13/504,106

(22) PCT Filed: Sep. 29, 2010

(86) PCT No.: PCT/JP2010/066883

§ 371 (c)(1),
(2), (4) Date: Apr. 25, 2012

(87) PCT Pub. No.: WO2011/052328

PCT Pub. Date: May 5, 2011

(65) Prior Publication Data

US 2012/0212387 A1 Aug. 23, 2012

(30) Foreign Application Priority Data

Oct. 28, 2009 (JP) ..... 2009-247300
Jan. 23, 2010 (JP) ..... 2010-012652

(51) Int. Cl.
*H01P 1/205* (2006.01)
*H01P 7/04* (2006.01)

(52) U.S. Cl.
CPC ..... *H01P 1/2053* (2013.01); *H01P 1/2056* (2013.01); *H01P 7/04* (2013.01)
USPC ..... 333/202; 333/206; 333/222

(58) Field of Classification Search
CPC ..... H01P 1/2056; H01P 1/2053; H01P 7/04
USPC ..... 333/202, 206, 222
See application file for complete search history.

(56) References Cited

U.S. PATENT DOCUMENTS 4,223,287 A * 9/1980 Nishikawa et al. ..... 333/206
5,109,207 A * 4/1992 Aizawa et al. ..... 333/222

(Continued)

FOREIGN PATENT DOCUMENTS

CN 1180942 A 5/1998
JP 3101017 U 10/1991
JP 0563411 A 3/1993

OTHER PUBLICATIONS

Chinese language office action dated Nov. 1, 2013 and its English language Concise Explanation issued in corresponding Chinese application 201080045391.9.

(Continued)

*Primary Examiner* — Benny Lee
(74) *Attorney, Agent, or Firm* — Volpe and Koenig, P.C.

(57) ABSTRACT

A coaxial resonator includes a dielectric block; a first inner conductor disposed in an inner surface of a first through hole which extends from a first main surface of the dielectric block to an opposite second main surface thereof, the first inner conductor being connected to a reference potential at one side thereof; and an outer conductor disposed over side surfaces of the dielectric block, the outer conductor surrounding the first inner conductor, the outer conductor being connected to the reference potential. There is a low-dielectric-constant portion in a location between the first inner conductor and the outer conductor. The low-dielectric-constant portion surrounds a periphery of the first inner conductor and is lower in dielectric constant than the dielectric block.

4 Claims, 6 Drawing Sheets

(56) References Cited

U.S. PATENT DOCUMENTS

| | | | | |
|---|---|---|---|---|
| 5,764,118 | A | 6/1998 | Saito et al. | |
| 5,952,897 | A | 9/1999 | Ogura et al. | |
| 6,204,738 | B1 * | 3/2001 | Toda et al. | 333/206 |
| 6,236,288 | B1 * | 5/2001 | Tsujiguchi | 333/134 |
| 6,294,969 | B1 * | 9/2001 | Matsuo et al. | 333/206 |
| 2009/0146761 | A1 * | 6/2009 | Nummerdor | 333/202 |

OTHER PUBLICATIONS

Extended European search report dated Jan. 2, 2014 issued in corresponding European application 10826462.3.

Chinese language office action dated Jun. 19, 2014 and its English language Concise Explanation issued in corresponding Chinese application 201080045391.9.

* cited by examiner

COAXIAL RESONATOR AND DIELECTRIC FILTER FORMED FROM A DIELECTRIC BLOCK WITH AT LEAST ONE INNER CONDUCTOR SURROUNDED BY A NON-CONDUCTIVE RECESS

CROSS-REFERENCE TO THE RELATED APPLICATIONS

This application is a national stage of international application No. PCT/JP2010/066883, filed on Sep. 29, 2010 and claims the benefit of priority under 35 USC 119 to Japanese Patent Application No. 2009-247300, filed on Oct. 28, 2009 and Japanese Patent Application No. 2010-012652, filed on Jan. 23, 2010, the entire contents of all of which are incorporated herein by reference.

TECHNICAL FIELD

The present invention relates to a coaxial resonator having excellent electrical characteristics, and a dielectric filter, a wireless communication module and a wireless communication device including the coaxial resonator.

BACKGROUND ART

As a resonator for effecting resonance at a predetermined frequency, there has been known a coaxial resonator composed of a dielectric block, an inner conductor disposed in an inner surface of a through hole formed in the dielectric block, and an outer conductor disposed externally of the dielectric block (refer to Patent literature 1, for example).

CITATION LIST

Patent literature

Patent literature 1: Japanese Unexamined Patent Publication JP-A 1-227501 (1989)

SUMMARY OF THE INVENTION

Technical Problem

However, there has been a problem in the conventional-type coaxial resonator as proposed in Patent literature 1 in that the increasing of a Q value in the first resonant mode and the widening of the resonance frequency gap between the first resonant mode and the second resonant mode are difficult to achieve concurrently. Note that the first resonant mode refers to, among many existing resonant modes of the coaxial resonator, a resonant mode of the lowest resonance frequency, whereas the second resonant mode refers to a resonant mode of the second lowest resonance frequency. In general, the first resonant mode of coaxial resonators is used, and therefore the increasing of a Q value in the first resonant mode involves the improvement in the electrical characteristics of the coaxial resonator. Furthermore, the second resonant mode, becoming a spurious component, should desirably be apart in frequency from the first resonant mode.

The invention has been devised in view of the problem associated with the conventional art as mentioned supra, and accordingly an object of the invention is to provide a coaxial resonator having a high Q value in the first resonant mode and a wide resonance frequency gap between the first resonant mode and the second resonant mode, as well as to provide a dielectric filter, a wireless communication module, and a wireless communication device employing the same.

Solution to the Problem

A first coaxial resonator pursuant to the invention includes: a dielectric block; a first inner conductor disposed in an inner surface of a first through hole which extends from a first main surface of the dielectric block to an opposite second main surface thereof, the first inner conductor being connected to a reference potential at a side thereof toward the first main surface or at a side toward thereof the second main surface; and an outer conductor disposed over side surfaces of the dielectric block, the outer conductor surrounding the first inner conductor, the outer conductor being connected to the reference potential, wherein there is a low-dielectric-constant portion in a location between the first inner conductor and the outer conductor, and the low-dielectric-constant portion surrounds a periphery of the first inner conductor, and the low-dielectric-constant portion is lower in dielectric constant than the dielectric block.

Moreover, according to a second coaxial resonator pursuant to the invention, in the first coaxial resonator, the low-dielectric-constant portion is a recess which is disposed in the first main surface of the dielectric block.

Further, according to a third coaxial resonator pursuant to the invention, in the second coaxial resonator, the first inner conductor is connected to the reference potential at the side thereof toward the first main surface.

A dielectric filter pursuant to the invention includes: a plurality of any one of the first to third coaxial resonators, the plurality of the coaxial resonators comprising a plurality of the first through holes which comprise the first inner conductor in the respective inner surfaces and are arranged in a row in the dielectric block at distances; a second through hole being adjacent to one of the first through holes, the one of the first through holes being located at one end of the row, the second through hole extending from the first main surface to the second main surface of the dielectric block, the second through hole comprising a second inner conductor which is disposed in an inner surface of the second through hole and is electrically connected to an external circuit; and a third through hole being adjacent to another of the first through holes, the another of the first through holes being located at another end of the row, the third through hole extending from the first main surface to the second main surface of the dielectric block, the third through hole comprising a third inner conductor which is disposed in an inner surface of the third through hole and is electrically connected to an external circuit, wherein there is the low-dielectric-constant portion in a location between the first inner conductors and the outer conductor, and the low-dielectric-constant portion surrounds the periphery of each of the first inner conductors.

A wireless communication module pursuant to the invention includes: an RF section including the dielectric filter; and a baseband section connected to the RF section.

A wireless communication device pursuant to the invention includes: the wireless communication module; and an antenna connected to the RF section of the wireless communication module.

Advantages Effects of Invention

According to the coaxial resonator of the invention, it is possible to obtain a coaxial resonator having a high Q value in the first resonant mode and a wide resonance frequency gap between the first resonant mode and the second resonant mode.

DETAILED DESCRIPTION OF THE PREFERRED EMBODIMENTS

Hereinafter, a coaxial resonator pursuant to the invention will be described in detail with reference to the accompanying drawings.

First Embodiment

Figure 1:
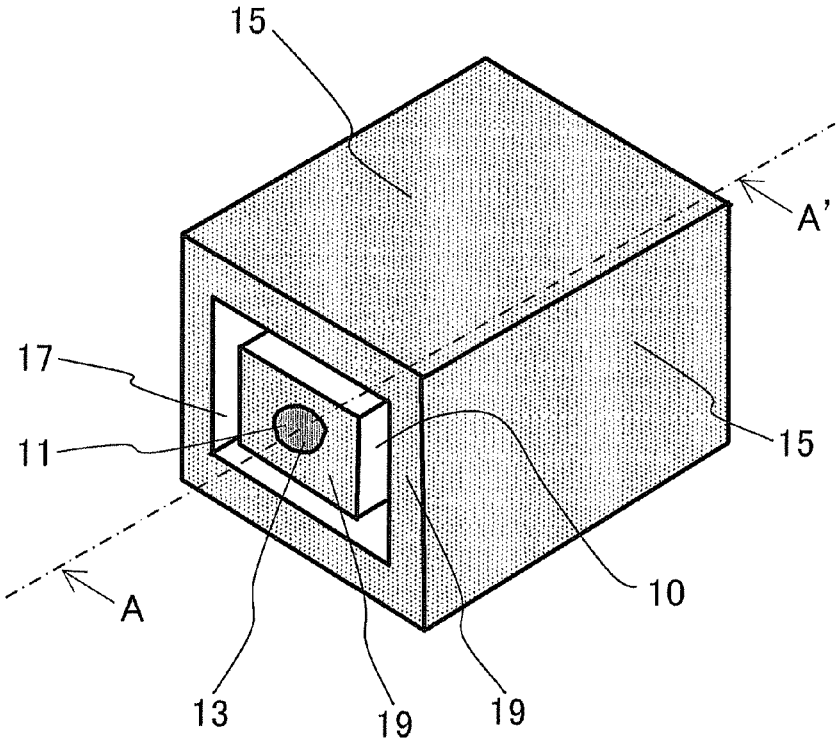
FIG. 1 is an external perspective view schematically showing a coaxial resonator in accordance with a first embodiment of the invention.
Figure 2:
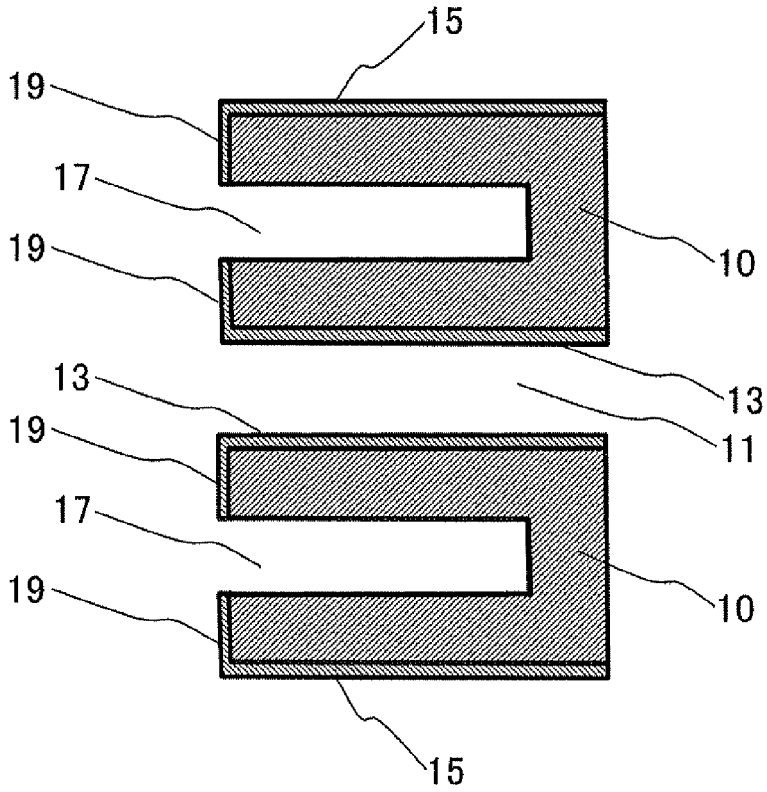
FIG. 2 is a sectional view of the coaxial resonator taken along the line A-A' shown in FIG. 1.

FIG. 1 is an external perspective view schematically showing a coaxial resonator in accordance with a first embodiment of the invention. FIG. 2 is a sectional view of the coaxial resonator taken along the line A-A' shown in FIG. 1.

As shown in FIGS. 1 and 2, the coaxial resonator of the embodiment includes a dielectric block 10, a through hole 11, a first inner conductor 13, an outer conductor 15, a recess 17, and a grounding conductor 19. The dielectric block 10 is formed of a rectangular parallelepiped dielectric body. The through hole 11 passes through the dielectric block 10 from a central part of a first main surface of the dielectric block 10 to a central part of an opposite second main surface thereof. The recess 17 is disposed between the outer edge of the first main surface of the dielectric block 10 and the through hole 11, at a distance to both of them, in the shape of a rectangular loop surrounding the periphery of the through hole 11. Moreover, no conductor is disposed in the inner surface of the recess 17, and therefore the inner surface of the recess 17 constitutes a conductor-free region. Further, since the interior of the recess 17 is filled with air, it follows that a dielectric constant of the interior of the recess 17 is lower than a dielectric constant of an area of the dielectric block 10 exclusive of the recess 17. That is, the interior of the recess 17 constitutes a low-dielectric-constant portion which is lower in dielectric constant than its neighboring dielectric block 10.

The grounding conductor 19 is disposed over the entire area of the first main surface of the dielectric block 10 exclusive of the recess 17, and is connected to a reference potential (ground potential). The outer conductor 15 extends throughout all of the four side surfaces of the dielectric block 10 while surrounding the first inner conductor 13. Moreover, the outer conductor 15 is connected to the grounding conductor 19 located outwardly of the recess 17 of one of the main surfaces of the dielectric block 10. Through the grounding conductor 19, the outer conductor 15 is connected to the reference potential (ground potential). The first inner conductor 13 lies over the entire area of the inner surface of the through hole 11. Moreover, one end of the first inner conductor 13 in its lengthwise direction is connected to the grounding conductor 19 located between the through hole 11 and the recess 17 at the first main surface of the dielectric block 10. Through the grounding conductor 19, the one end of the first inner conductor 13 is connected to the reference potential (ground potential). Note that the second main surface of the dielectric block 10 is designed as an open end without the placement of a conductor.

According to the coaxial resonator of the embodiment thusly constructed, there are provided the first inner conductor 13 and the outer conductor 15 surrounding the first inner conductor 13 at a distance, with the dielectric body lying in between. Therefore, for example, when one end of the first inner conductor 13, as well as the outer conductor 15, is connected to the reference potential (ground potential) through the grounding conductor 19, the coaxial resonator functions as a coaxial resonator for effecting resonance at a predetermined frequency.

Moreover, in the coaxial resonator of the embodiment, the first main surface of the dielectric block 10 is provided with the recess 17 which surrounds the periphery of the first inner conductor 13 in a location between the first inner conductor 13 and the outer conductor 15. Further, no conductor is disposed in the inner surface of the recess 17, and therefore the inner surface of the recess 17 constitutes a conductor-free region. In addition, the recess 17, being filled with air, serves as a low-dielectric-constant portion which is lower in dielectric constant than its neighboring dielectric block 10. In this construction, an electric field produced between the first inner conductor 13 and the outer conductor 15 is allowed to pass through the recess 17. Moreover, since the dielectric constant of the interior of the recess 17 is lower than the dielectric constant of the dielectric block 10, it is possible to decrease the effective dielectric constant of the region between the first inner conductor 13 and the outer conductor 15. Accordingly, in contrast to a coaxial resonator which has the same resonance frequency of the first resonant mode but is devoid of the recess 17 serving as a low-dielectric-constant portion, in the coaxial resonator of the embodiment, although the first inner conductor 13 needs to be designed to have a somewhat longer length, a higher Q value can be obtained in the first resonant mode. Note that research and studies based on electromagnetic field analysis conducted by the inventors have shown that the first resonant mode as employed herein is of a mode in which an electric field is oriented radially in a direction from the first inner conductor toward the outer conductor.

Further, according to the coaxial resonator of the embodiment, since the recess 17 serving as a low-dielectric-constant portion surrounds the whole periphery of the first inner conductor 13 continuously, it is possible to achieve a reduction in effective dielectric constant omnidirectionally around the periphery of the first inner conductor 13, and thereby widen the resonance frequency gap between the first resonant mode and the second resonant mode. That is, according to the result of electromagnetic field analysis-based research and studies conducted by the inventors, for example, in a case where the recess 17 is disposed at each of two locations that are opposed to each other, with the first inner conductor 13 portion existing on a straight line segment passing through the first inner conductor 13 lying in between, the second resonant mode is defined by a resonant mode in which an electric field is oriented perpendicular to the through hole 11 in a recess free region. After all, the advantageous effect of the recess 17 to widen the resonance frequency gap between the first resonant mode and the second resonant mode cannot be obtained at all. Furthermore, for example, in a case where an L-shaped recess 17 is disposed around the first inner conductor 13 in such a manner as to cover two sides of the first inner conductor 13 extending in different directions at a right angle as seen with respect to the first inner conductor 13, the second resonant mode is defined by a resonant mode in which an electric field is oriented perpendicular to the through hole 11 in a recess free L-shaped region corresponding to the other two sides. After all, there is little advantageous effect of the recess 17 to widen the resonance frequency gap between the first resonant mode and the second resonant mode. By way of contrast, in the coaxial resonator of the embodiment, since the recess 17 surrounds the whole periphery of the first inner conductor 13 continuously, it is possible to achieve a reduction in effective dielectric constant omnidirectionally around the periphery of the first inner conductor 13, and thereby widen the resonance frequency gap between the first resonant mode and the second resonant mode.

Still further, according to the coaxial resonator of this embodiment, since the first inner conductor 13 is connected to the ground potential at a side thereof toward the first main surface, it follows that the recess 17 serving as a low-dielectric-constant portion is situated around the grounded end of the first inner conductor 13. In this way, in contrast to a case where a low-dielectric-constant portion is formed around the open end of the first inner conductor 13, the resonance frequency gap between the first resonant mode and the second resonant mode can be widened even further. The reason why such an effect can be attained is probably because the effective dielectric constant of the region around the grounded end of the first inner conductor 13 becomes smaller than the effective dielectric constant of the region around the open end of the first inner conductor 13, with the consequence that the impedance at the grounded end of the first inner conductor 13 becomes greater than the impedance at the open end of the first inner conductor 13.

In order to obtain a remarkable advantageous effect, it is preferable that the depth dimension of the recess 17 is greater than or equal to one-half of the thickness dimension of the dielectric body between the first main surface and the second main surface of the dielectric block 10. Moreover, the larger the width of the recess 17 becomes, the greater the intended effect becomes. However, if the recess 17 has an unduly large width, the mechanical strength thereof will be decreased. Accordingly, it is advisable to set the width of the recess 17 at an appropriate value with consideration given to the dielectric constant, size, and mechanical strength of the dielectric block 10 and the level of the intended effect.

Second Embodiment

Figure 3:
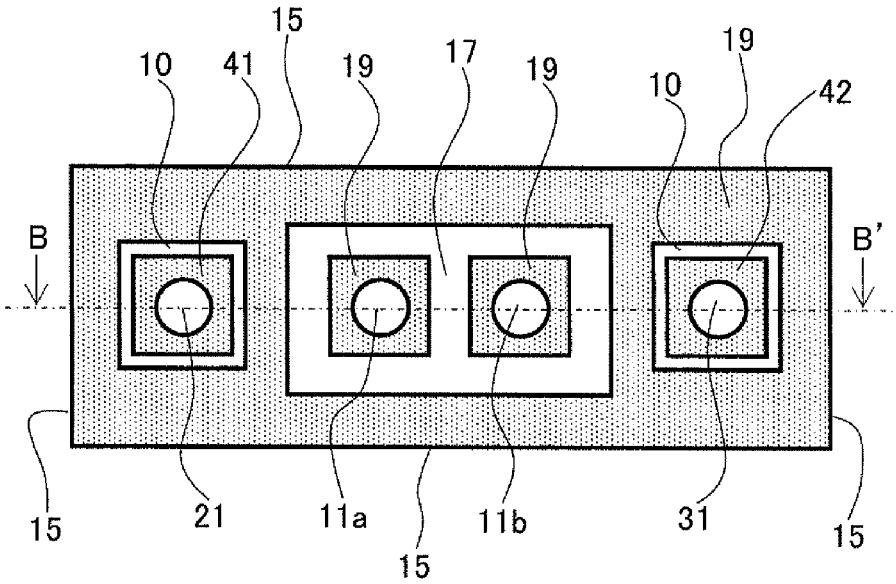
FIG. 3 is a plan view schematically showing a first main surface of a dielectric filter in accordance with a second embodiment of the invention.
Figure 4:
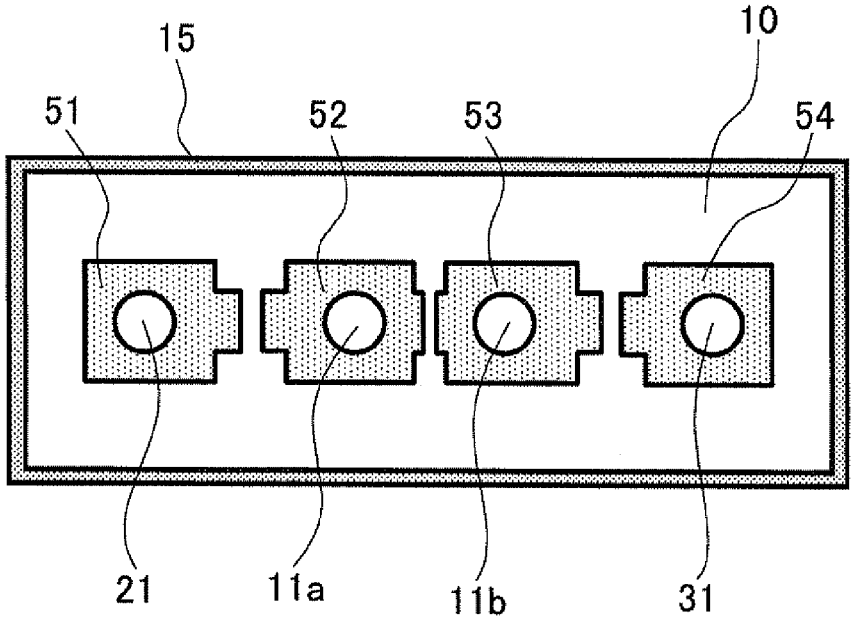
FIG. 4 is a plan view schematically showing a second main surface of the dielectric filter shown in FIG. 3.
Figure 5:
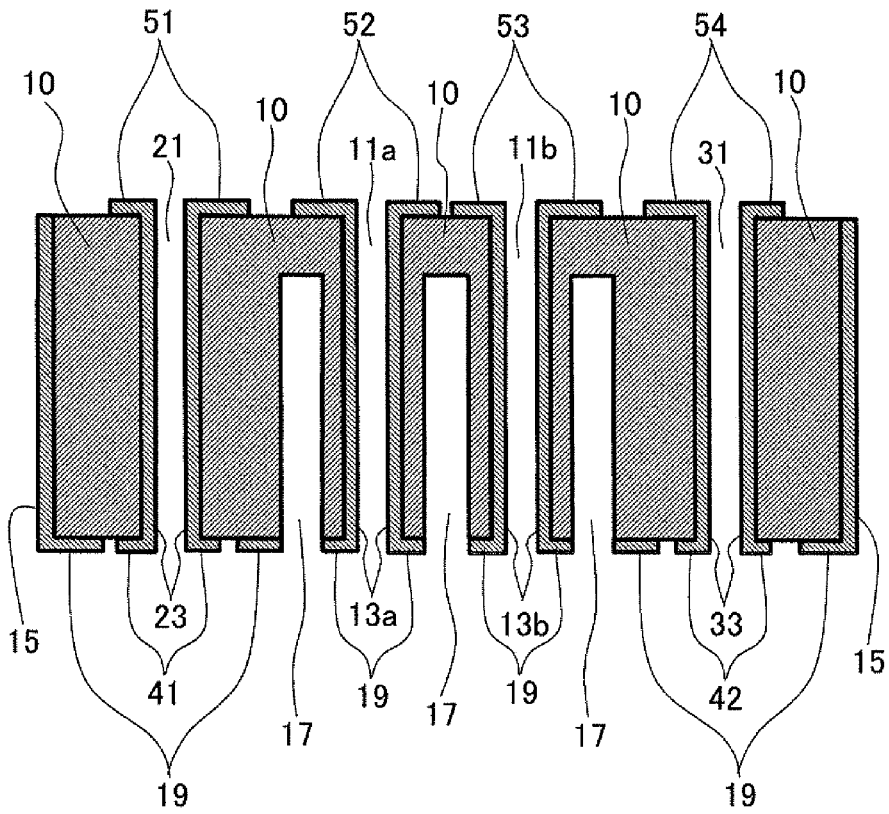
FIG. 5 is a sectional view of the dielectric filter taken along the line B-B' shown in FIG. 3.

FIG. 3 is a plan view schematically showing a first main surface of a dielectric filter in accordance with a second embodiment of the invention. FIG. 4 is a plan view schematically showing a second main surface of the dielectric filter shown in FIG. 3. FIG. 5 is a sectional view of the dielectric filter taken along the line B-B' shown in FIG. 3. Note that the following description deals only with the points of difference from the preceding embodiment, and the constituent components of the second embodiment similar to those of the preceding embodiment will be identified with like reference symbols, and overlapping descriptions will be omitted.

As shown in FIGS. 3 to 5, the dielectric filter of the embodiment includes a dielectric block 10, a plurality of first through holes 11*a* and 11*b*, a second through hole 21, a third through hole 31, a recess 17 (FIGS. 3, 5), a plurality of first inner conductors 13*a* and 13*b*, a second inner conductor 23 (FIG. 5), a third inner conductor 33 (FIG. 5), an outer conductor 15, a grounding conductor 19, a first input-output electrode 41 (FIGS. 3, 5), a second input-output electrode 42 (FIGS. 3, 5), and first to fourth capacitance electrodes 51, 52, 53 and 54 (FIGS. 4, 5).

The plurality of first through holes 11*a* and 11*b* are arranged in a row in the dielectric block at distances, and extend from a first main surface of the dielectric block to an opposite second main surface thereof. The first inner conductor 13*a* lies over the entire area of the inner surface of the first through hole 11*a*, and likewise the first inner conductor 13*b* lies over the entire area of the inner surface of the first through hole 11*b*. Moreover, the first inner conductor 13*a*, 13*b* is connected, at a side thereof toward the first main surface, to the grounding conductor 19 (FIGS. 4 and 5). Through the grounding conductor 19, the first inner conductors 13*a* and 13*b* are connected to the ground potential.

The recess 17 is disposed in the first main surface of the dielectric block 10 and surrounds the peripheries of the first inner conductors 13*a* and 13*b* continuously in a location between the first inner conductor 13*a*, 13*b* and the outer conductor 15. The inner surface of the recess 17 constitutes a conductor-free region.

The second through hole 21 is adjacent to the first through hole 11*a* located at one end of the row, and extends from the first main surface to the second main surface of the dielectric block 10. The second inner conductor 23 is disposed in the inner surface of the second through hole 21 while making connection with the first input-output electrode 41 disposed in the first main surface of the dielectric block 10. Through the first input-output electrode 41, the second inner conductor 23 is electrically connected to an external circuit.

The third through hole 31 is adjacent to the first through hole 11*b* located at the other end of the row, and extends from the first main surface to the second main surface of the dielectric block 10. The third inner conductor 33 is disposed in the inner surface of the third through hole 31 while making connection with the second input-output electrode 42 disposed in the first main surface of the dielectric block 10. Through the second input-output electrode 42, the third inner conductor 33 is electrically connected to an external circuit.

The grounding conductor 19 is disposed in an area of the first main surface of the dielectric block 10 exclusive of the recess 17 so as to be spaced away from the first input-output electrode 41 and the second input-output electrode 42, and is connected to the ground potential. The outer conductor 15 extends throughout all of the four side surfaces of the dielectric block 10 while surrounding the first inner conductors 13*a* and 13*b*, and is connected to the grounding conductor 19. Through the grounding conductor 19, the outer conductor 15 is connected to the ground potential.

The first to fourth capacitance electrodes 51 to 54 are arranged side by side at the second main surface of the dielectric block 10. A predetermined electrostatic capacitance is made between the adjacent capacitance electrodes. Moreover, the first capacitance electrode 51 is connected to the second inner conductor 23, the second capacitance electrode 52 is connected to the first inner conductor 13*a*, the third capacitance electrode 53 is connected to the first inner conductor 13*b*, and the fourth capacitance electrode 54 is connected to the third inner conductor 33.

In the dielectric filter of the embodiment thusly constructed, upon the input of an electric signal to the second inner conductor 23 via the first input-output electrode 41 connected to an external circuit, then the coaxial resonator composed of the first inner conductor 13*a* and the outer conductor 15 is excited mainly by a coupling based on electrostatic capacitance between the first capacitance electrode 51 and the second capacitance electrode 52. Also, the coaxial resonator composed of the first inner conductor 13*b* and the outer conductor 15 is excited mainly by a coupling based on electrostatic capacitance between the second capacitance electrode 52 and the third capacitance electrode 53. Then, mainly by a coupling based on electrostatic capacitance between the third capacitance electrode 53 and the fourth capacitance electrode 54, the electric signal is outputted via the third inner conductor 33 and the second input-output electrode 42. At this time, since signals that lie in a certain frequency band including the resonance frequency of the coaxial resonator are selectively passed, the dielectric filter functions as a bandpass filter.

Thus, the dielectric filter of this embodiment is constructed by forming the plurality of the coaxial resonators of the first embodiment as described previously in the dielectric block 10. By electrically coupling these coaxial resonators to each other, a bandpass filter is implemented.

According to the dielectric filter of the embodiment thusly constructed, a bandpass filter is implemented with use of the coaxial resonators having a high Q value and a wide resonance frequency gap between the first resonant mode and the second resonant mode. Accordingly, it is possible to obtain a dielectric filter having low losses, a small spurious extent in the vicinity of pass band, and excellent frequency selectivity.

Moreover, according to the dielectric filter of the embodiment, the recesses 17 surrounding the peripheries of the plurality of first inner conductors 13*a* and 13*b*, respectively, are integral in one piece, and therefore the first inner conductors 13*a* and 13*b* can be arranged adjacent each other without undesirable wasted space and deterioration in mechanical strength.

In the dielectric filter of the embodiment, and in the above-stated coaxial resonator of the first embodiment as well, as the material of construction of the dielectric block 10, for example, a resin material such as epoxy resin or ceramics such as dielectric ceramics can be used. For example, a glass-ceramic material is desirable for use that is composed of a dielectric ceramic material such as $BaTiO_3$, $Pb_4Fe_2Nb_2O_{12}$, or $TiO_2$, and a glass material such as $B_2O_3$, $SiO_2$, $Al_2O_3$, or ZnO, and can be fired at relatively low temperatures ranging from about 800° C. to 1200° C. As the material of construction of various electrodes and conductors for use, for example, an electrically conductive material composed predominantly of a Ag alloy such as Ag, Ag—Pd, or Ag—Pt, a Cu-based conductive material, a W-based conductive material, a Mo-based conductive material, a Pd-based conductive material, and so forth are desirable for use. The thickness of each of the electrodes and conductors is adjusted to fall in a range of 0.001 mm to 0.2 mm, for example.

Third Embodiment

Figure 6:
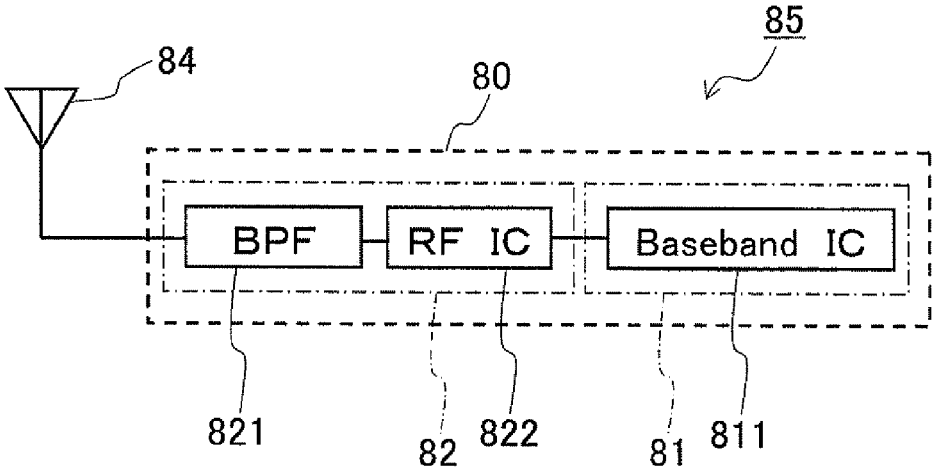
FIG. 6 is a block diagram schematically showing a wireless communication module and a wireless communication device in accordance with a third embodiment of the invention.

FIG. 6 is a block diagram schematically showing a wireless communication module 80 and a wireless communication device 85 in accordance with a third embodiment of the invention.

The wireless communication module 80 of this embodiment includes a baseband section 81 configured to process baseband signals and an RF section 82 connected to the baseband section 81, and configured to process RF signals obtained after modulation or before demodulation of baseband signals. The RF section 82 includes a dielectric filter (BPF) 821 based on the above-stated second embodiment. In the RF section 82, out of RF signals resulting from modulation of baseband signals or received RF signals, those that lie outside the communication band are attenuated by the dielectric filter (BPF) 821.

More specifically, in this construction, the baseband section 81 includes a baseband IC 811, and the RF section 82 includes an RF IC 822 connected between the dielectric filter 821 and the baseband section 81. Note that another circuit may be interposed between these circuits. With the connection of an antenna 84 to the dielectric filter 821 of the wireless communication module 80, the construction of the wireless communication device 85 of the embodiment for transmission and reception of RF signals will be completed.

According to the wireless communication module 80 and the wireless communication device 85 of the embodiment thus constructed, since wave filtering is performed on communication signals with use of the dielectric filter 821 having lower loss and excellent frequency selectivity, it is possible to decrease attenuation and noise of communication signals, and thereby impart high-quality communication performance capability to the wireless communication module 80 and the wireless communication device 85.

Modified Examples

It should be understood that the application of the invention is not limited to the specific embodiments described heretofore, and that various changes and modifications are possible without departing from the spirit and scope of the invention. Where the above-described first and second embodiments are concerned, although there is described a case where the recess 17 having the shape of a rectangular frame is formed, the invention is not limited thereto. It is sufficient only that the recess 17 is disposed between the inner conductor and the outer conductor and surrounds the inner conductor at a distance. For example, the recess 17 may be given the shape of a polygonal frame instead of the rectangular frame, or may be annular-shaped. Also, the recess 17 may be given a shape like the letter "C" so that it surrounds two-thirds or more of the periphery of the inner conductor rather than having the shape of a continuous ring. Moreover, it is possible to arrange a plurality of recesses 17 at predetermined spacing and surround the periphery of the inner conductor. In this case, if the adjacent recesses 17 are situated at widely spaced points, the effectiveness of the recesses will be reduced. Therefore, it is desirable to minimize the spacing between the adjacent recesses 17.

Moreover, where the above-described first and second embodiments are concerned, although there is described a case where the recess 17 whose interior is filled with air constitutes a low-dielectric-constant portion, the invention is not limited thereto. For example, the interior of the recess 17 may be filled with a dielectric material which is smaller in dielectric constant than its neighboring dielectric block. Also, the low-dielectric-constant portion may be made of a space disposed inside the dielectric block instead of the recess 17 disposed in the surface of the dielectric block. In this case, a vacuum may be created in the space, or alternatively the space may be filled with a dielectric material which is lower in dielectric constant than its neighboring dielectric block (including air).

Moreover, where the above-described dielectric filter of the second embodiment is concerned, there is described a case where a single recess 17 in one-piece form surrounds the plurality of first inner conductors 13*a* and 13*b*. However, the plurality of recesses 17 may surround the plurality of first inner conductors, respectively.

Further, where the above-described first and second embodiments are concerned, there is described a case where the first inner conductor 13 and the outer conductor 15 are connected to the ground potential at the side of the first main surface of the dielectric block 10 formed with the recess 17. However, the first inner conductor 13 and the outer conductor 15 may be connected to the ground potential at the side of the second main surface of the dielectric block 10.

Still further, where the above-described dielectric filter of the second embodiment is concerned, there is described a case where there are provided two coaxial resonators composed of two first inner conductors 13*a* and 13*b* arranged in two first through holes 11*a* and 11*b*, respectively, of the dielectric block 10 and the outer conductor 15. However, the invention is not limited thereto. It is therefore possible to provide three or more coaxial resonators. In general, the resonators are provided in a total number not exceeding about 20, because an increase in the number of resonators leads to apparatus upsizing.

EXAMPLES

Next, concrete examples of the coaxial resonator pursuant to the invention will be described.

The electrical characteristics of the coaxial resonator implemented by way of the first embodiment of the invention as shown in FIGS. 1 and 2 were calculated by a simulation in accordance with the finite element method. A frequency gap between the resonance frequency of the first resonant mode and the resonance frequency of the second resonant mode and an unloaded Q in the first resonant mode were selected as target electrical characteristics to be determined by calculation.

The conditions set for the coaxial resonator subjected to this simulation were: the dielectric body constituting the dielectric block 10 had a relative permittivity of 15 and a dielectric loss tangent of 0.0001; the conductors in use were made of copper; the dielectric block 10 had the form of a rectangular parallelepiped which was 16 mm in length and width, and was 12.5 mm in the distance from the first main surface to the second main surface thereof; the through hole 11 had a diameter of 4.444 mm; the recess 17 had a width of 1.778 mm and surrounded the through hole 11 at a center of the region between the outer edge of the first main surface, as well as the second main surface, and the through hole 11; and the interior of the recess bore air. In order to obtain a simulation model, this coaxial resonator was placed in a rectangular parallelepiped cavity surrounded by a conductor, with its first main surface and four side surfaces kept in contact with the inner wall of the cavity, and with its second main surface opposed to the inner wall at a distance of 5 mm.

At this time, in the first resonant mode, a resonance frequency of 1.95 GHz and a Q value of 2382 were observed. Moreover, in the second resonant mode, a resonance frequency of 4.47 GHz was observed. That is, the resonance frequency gap between the first resonant mode and the second resonant mode was found to be 2.52 GHz.

On the other hand, in a coaxial resonator devoid of the recess 17 implemented by way of a comparative example, under the condition that the distance from the first main surface to the second main surface is 9.6 mm, although the resonance frequency of the first resonant mode was 1.96 GHz which is nearly equal to that of the coaxial resonator of the invention, the Q value of the first resonant mode was 2098. This value was smaller by more than 10% from that of the coaxial resonator of the invention. Furthermore, the resonance frequency of the second resonant mode was 3.63 GHz. That is, the resonance frequency gap between the first resonant mode and the second resonant mode was found to be 1.67 GHz. This value is smaller by more than 30% from that of the coaxial resonator of the invention. It will thus be seen that the invention has proven itself.

REFERENCE SIGNS LIST

10: Dielectric block
11, 11*a*, 11*b*: First through hole
13, 13*a*, 13*b*: First inner conductor
15: Outer conductor
17: Recess
21: Second through hole
23: Second inner conductor
31: Third through hole
33: Third inner conductor
80: Wireless communication module
81: Baseband section
82: RF section
821: Dielectric filter
84: Antenna
85: Wireless communication device

The invention claimed is:

1. A coaxial resonator, comprising:

a dielectric block;

a first inner conductor disposed in an inner surface of a first through hole that extends from a first main surface of the dielectric block to an opposite second main surface thereof, the first inner conductor being connected to a reference potential at a side thereof toward the first main surface; and an outer conductor disposed over side surfaces of the dielectric block, the outer conductor surrounding the first inner conductor, the outer conductor being connected to the reference potential, wherein there is a low-dielectric-constant portion in a location between the first inner conductor and the outer conductor, the low-dielectric-constant portion surrounds a periphery of the first inner conductor, the low-dielectric-constant portion is lower in dielectric constant than the dielectric block, the low-dielectric-constant portion is a recess that is disposed in the first main surface of the dielectric block, the recess continuously surrounds the periphery of the first inner conductor, and an inner surface of the recess is a conductor-free region.

2. A dielectric filter, comprising:

a dielectric block;

a plurality of first through holes extending from a first main surface of the dielectric block to an opposite second main surface thereof, the plurality of first through holes being arranged in a row in the dielectric block, wherein two adjacent through holes of the plurality of first through holes are arranged at an interval;

first inner conductors connected to a reference potential at sides thereof toward the first main surface, respectively, the first inner conductors being disposed in inner surfaces of the first through holes, respectively;

a second through hole being adjacent to one of the first through holes, the one of the first through holes being located at one end of the row, the second through hole extending from the first main surface to the second main surface of the dielectric block;

a second inner conductor that is disposed in an inner surface of the second through hole and is electrically connected to an external circuit;

a third through hole being adjacent to another of the first through holes, the another of the first through holes being located at another end of the row, the third through hole extending from the first main surface to the second main surface of the dielectric block;

a third inner conductor that is disposed in an inner surface of the third through hole and is electrically connected to the external circuit;

an outer conductor disposed over side surfaces of the dielectric block, the outer conductor surrounding all of the first inner conductors, the outer conductor being connected to the reference potential; and a low-dielectric-constant portion being disposed in a location between each of the first inner conductors and the outer conductor, the low-dielectric-constant portion surrounding a periphery of each of the first inner conductors, and the low-dielectric-constant portion being lower in dielectric constant than the dielectric block, the low-dielectric-constant portion being a recess that is disposed in the first main surface of the dielectric block, wherein the recess continuously surrounds the periphery of each of the first inner conductors, wherein an inner surface of the recess is a conductor-free region.

3. A wireless communication module, comprising:

an RF section including the dielectric filter according to claim 2; and a baseband section connected to the RF section.

4. A wireless communication device, comprising:

the wireless communication module according to claim 3; and an antenna connected to the RF section of the wireless communication module.

* * * * *